United States Patent [19]

Chisholm

[11] 3,965,970

[45] June 29, 1976

[54] CONTROL OF TWO-PHASE THERMOSYPHONS

[75] Inventor: Duncan Chisholm, Strathaven, Scotland

[73] Assignee: The Secretary of State for Industry in Her Britannic Majesty's Government of the United Kingdom of Great Britain and Nothern Ireland, London, England

[22] Filed: Oct. 10, 1974

[21] Appl. No.: 513,744

[30] Foreign Application Priority Data

Oct. 11, 1973 United Kingdom ..... 47498/73

[52] U.S. Cl. ..... 165/32; 165/105

[51] Int. Cl.[2] ..... F28D 15/00

[58] Field of Search ..... 165/105, 32, 96; 122/33

[56] References Cited

UNITED STATES PATENTS

| | | | |
|---|---|---|---|
| 2,529,915 | 11/1950 | Chausson | 165/105 X |
| 3,112,890 | 12/1963 | Snelling | 165/105 X |
| 3,511,310 | 5/1970 | Loo | 165/105 |

FOREIGN PATENTS OR APPLICATIONS

| | | | |
|---|---|---|---|
| 832,175 | 6/1938 | France | 122/33 |
| 605,948 | 8/1948 | United Kingdom | 165/105 |
| 122,566 | 7/1958 | U.S.S.R. | 165/105 |

*Primary Examiner*—Albert W. Davis, Jr.
*Attorney, Agent, or Firm*—Cameron, Kerkam, Sutton, Stowell & Stowell

[57] ABSTRACT

A two-phase thermosyphon having an evaporator where heat can be absorbed accompanied by the vapourisation of liquid contained therein, a condenser where heat can be given up by condensation of vapour and a condenser reservoir associated with the condenser and which can retain condensate from the condenser, is provided with means, such as a vapour lift pump having a controllable flow connecting tube with a lower end in the condenser reservoir, for controlling the level of liquid in the condenser reservoir which determines the rate of heat transfer through the thermosyphon.

1 Claim, 6 Drawing Figures

Figures 3, 3A:
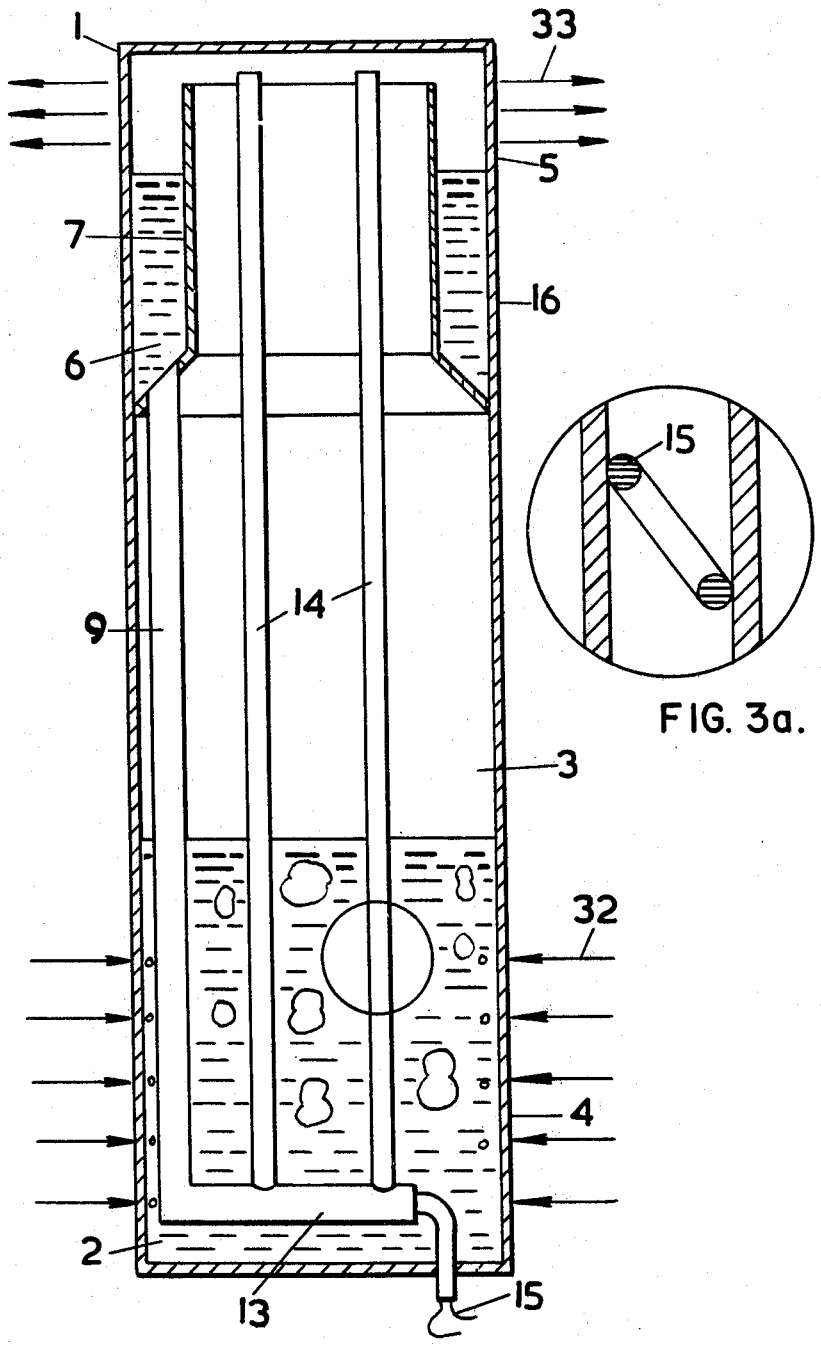

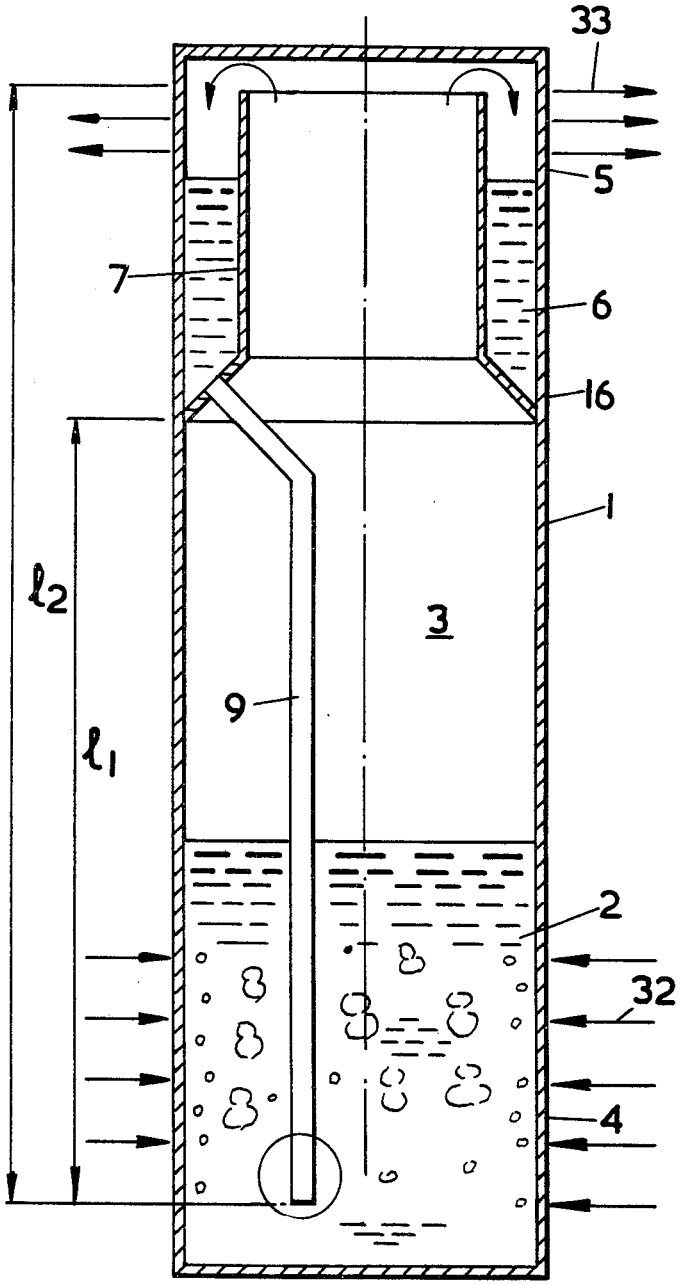
FIG. 1.
FIG. 1a.
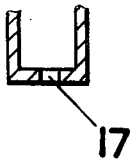

CONTROL OF TWO-PHASE THERMOSYPHONS

This invention relates to two-phase thermosyphons which typically comprise a closed vessel containing a suitable liquid and its vapour. If one part of the vessel, constituting and hereinafter referred to as an evaporator, containing liquid is located adjacent a heat source and another part, constituting and hereinafter referred to as a condenser, is located adjacent a heat sink, heat may be absorbed in the evaporator accompanied by the liquid's vaporising and heat may be given up by the vapour's condensing in the condenser. More particularly the present invention relates to such two-phase thermosyphons, having means for regulating the rate of heat transfer by the thermosyphon from the heat source to the heat sink.

A two-phase thermosyphon according to the invention comprises a closed vessel containing a suitable liquid and its vapour and having an evaporator where heat can be absorbed accompanied by vaporisation of liquid and a condenser where heat may be given up by condensation of vapour whereby heat can be transferred from a heat source adjacent the evaporator to a heat sink adjacent the condenser, and incorporating a condenser reservoir located adjacent the condenser and adapted to receive and retain condensate from the condenser and means for controlling the level of condensate in the condenser reservoir to control the rate of condensation.

By controlling the level of the condensate in the condenser reservoir the effective area of the condenser surface in contact with the vapour and hence the rate of condensation may be controlled.

As heat transfer through the condenser reservoir is generally small, the heat transfer of the thermosyphon will substantially be determined by controlling the level of condensate in the condenser reservoir.

In one arrangement of the invention the thermosyphon vessel, which may conveniently be tubular, has the condenser at or near its upper end and the evaporator at or near its lower end, and the condenser reservoir may be annular in cross section with its outer cylindrical surface integral or in contact with the wall of the thermosyphon vessel.

In another arrangement of the invention a supplementary condenser and associated reservoir located inside or outside of the thermosyphon vessel may be provided having means, such as a thermostatic valve between the associated reservoir and the evaporator, for controlling the level of liquid condensate in the supplementary condenser to control the rate of condensation, and hence heat transfer in the thermosyphon.

In one means of controlling the level of liquid condensate in the condenser reservoir, a connecting tube is connected between the condenser reservoir and the evaporator through which tube condensate from the condenser is returned to the evaporator, the connecting tube having means for restricting the flow of liquid therein. The means of restricting the flow may conveniently comprise an orifice preferably located at the evaporator end of the connecting tube. If the ratio of the maximum variation in liquid level in the condenser is small compared with the distance of the orifice from the condenser, then the maximum variation in condensate flow rates through the orifice can be small, and the rate of heat transfer from the heat source to the heat sink by the thermosyphon will be approximately constant over a wide range of conditions. The maximum variation in the rate of heat transfer may be further reduced by having a plurality of axially spaced condenser reservoirs.

A plurality of connecting tubes from the condenser reservoir to the evaporator, or one from each condenser reservoir to the evaporator, may be employed, each tube having an orifice and means for selectively stopping the flow of liquid through the orifices. The means for stopping the flow may comprise supplementary heating at or near the orifice to generate vapour above the orifice in the connecting tube. Thermostatic control valves, one in each connecting tube, may be employed to control the flow of liquid condensate in the connecting tube. The operation of the valves may be controlled by the temperature of the vapour in the thermosyphon tube.

In another means for controlling the level of liquid condensate in the condenser reservoir, a riser tube has one end open to the vapour in the thermosyphon tube at a level near or above the maximum liquid level in the condenser reservoir and the other end communicating with the condenser reservoir at a low point in the reservoir, the riser tube having supplementary heating to produce a vapour lift pump in the riser tube. The supplementary heating, such as an electrical heater, may be arranged to produce a liquid/ vapour mixture in the riser tube and the density of the liquid in the condenser reservoir would produce a flow of liquid/vapour mixture out of the end of the riser tube open to the vapour, from whence liquid may be returned to the evaporator. In this arrangement of the invention the rate of heat transfer by the thermosyphon may be controlled by controlling the supplementary heating, and/or by having a plurality of riser tubes each having supplementary heating and controlling the number of risers heated by the supplementary heating.

Figure 2:
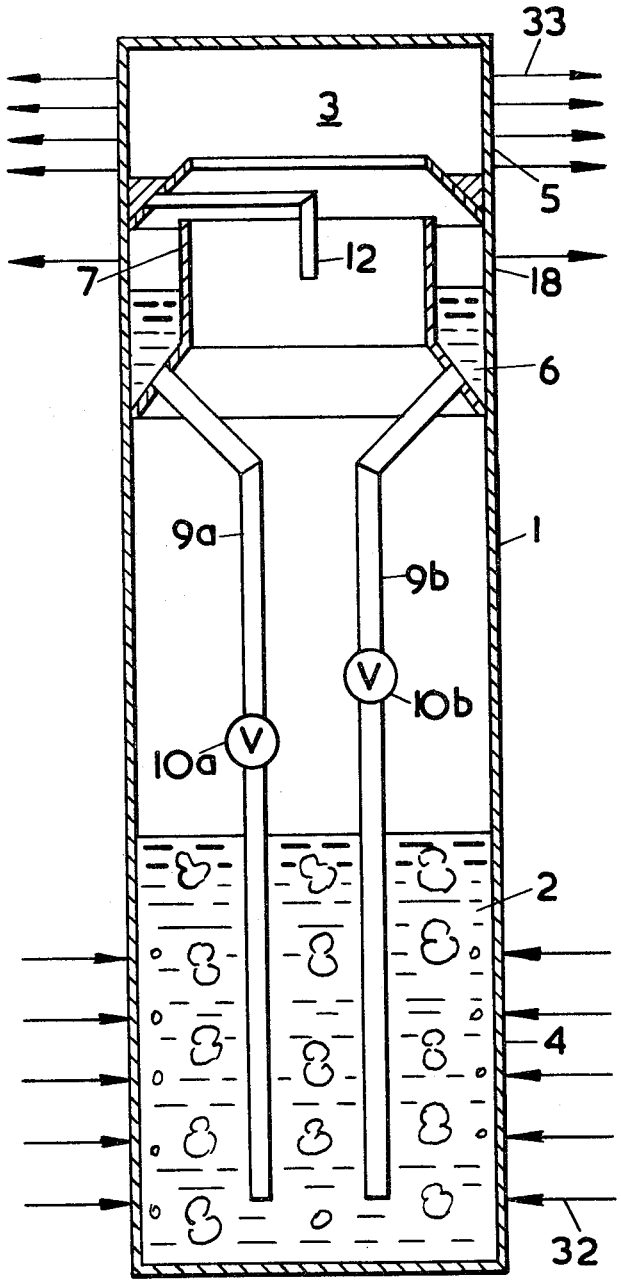
Figure 4:
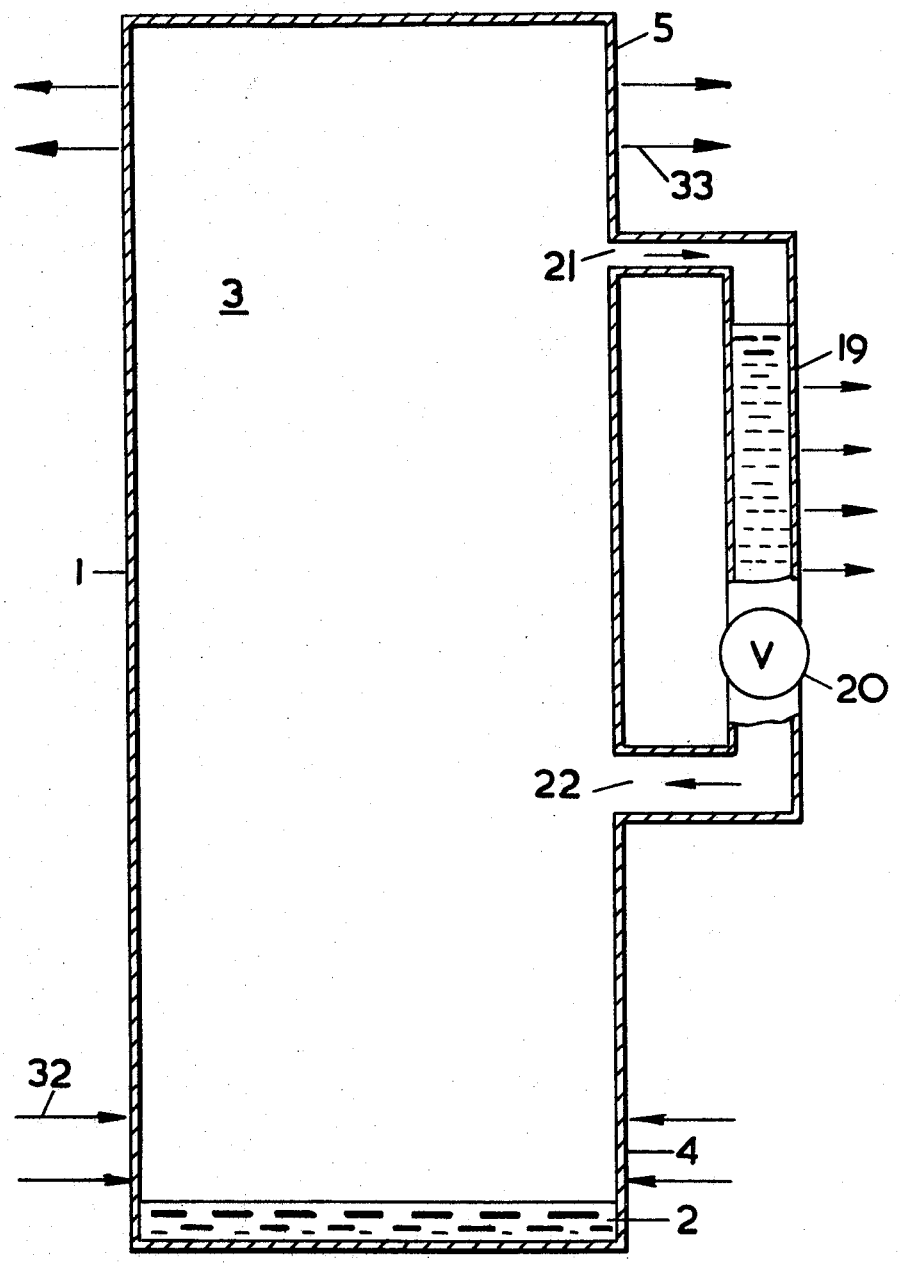

Examples of the invention will now be described with reference to the accompanying drawings of which:

FIGS. 1 and 1*a* constitute a schematic cross sectional view of one arrangement of thermosyphon, having a connecting tube communicating between the condenser and evaporator with an orifice for controlling the liquid level in the condenser; FIG. 1*a* is a magnification of that area of FIG. 1 within the circle;

FIG. 2 is a schematic cross sectional view of another arrangement of thermosyphon in which the level of liquid in the condenser is controlled by the vapour temperature in the thermosyphon;

FIGS. 3 and 3*a* constitute a schematic cross sectional view of a further arrangement of thermosyphon in which the level of liquid in the condenser is controlled by means of an internal vapour lift pump; FIG. 3*a* is a magnification of that area of FIG. 3 within the circle; and FIG. 4 is a schematic cross sectional view of a still further arrangement of thermosyphon having a supplementary condenser and associated reservoir.

The thermosyphon illustrated in FIG. 1 comprises a vertically standing hermetically sealed tubular vessel 1 containing a suitable liquid 2 and its vapour 3. The evaporator 4 is located at the lower part of the tube 1 adjacent a heat source represented by arrows 32 and the condenser 5 is located at the upper part of the tube 1 adjacent the heat sink represented by arrows 33. An annular condenser reservoir 16 is located immediately below the condenser 5, and has its internal wall constituted by baffles 7, and its external wall constituted by part of the wall of the thermosyphon tube 1. A connecting tube 9, hereinafter referred to as a downcomer tube, connects the condenser reservoir 16 to the evaporator 4. One end of the downcomer tube communicates with the bottom of the condenser reservoir 16 and the other end, which is preferably located near the bottom of the evaporator 4 has an orifice 17.

In operation, the vapour is produced in the evaporator 4 at the part of the thermosyphon tube adjacent the heat source 32, and passes up through the centre of the annular condenser reservoir 16 and condenses on the internal cylindrical walls at the top of the thermosyphon tube. The resultant liquid condensate flows under gravity into the condenser reservoir 16. Heat transfer through the liquid condensate 6 in the condenser reservoir 16 is very small compared with the heat transfer of the vapour condensing on the effective area of the condenser surface, which is the cylindrical surface of the thermosyphon tube 1 above the liquid level in the condenser reservoir 16. By controlling the level of the liquid condensate 6 in the condenser reservoir 16 the effective area of the condenser surface and hence the heat transfer rate through the thermosyphon tube can be controlled.

The rate of flow $m_2$ of condensate through the orifice 17 when the condenser reservoir 16 is full can be approximately related to the flow $m_1$ when the condensate level is at the bottom of the condenser reservoir 16 as $$\frac{m_2}{m_1} = \left(\frac{l_2}{l_1}\right)^{0.5}$$

where $1_2$ is the distance from the top of the condenser reservoir 16 to the orifice 17 at the bottom end of the downcomer tube 9, and $1_1$ is the distance from the bottom of the condenser to the orifice 17 as shown in FIG. 1. If the ratio $^12/1_1$ is close to unity, the variation in condensate flow rates from the condenser reservoir 16 to the evaporator 4 will be small. By designing the thermosyphon so that the ratio $^12/1_1$ is close to unity, the condensate flow rate can be kept substantially constant over a wide range of operating conditions. As the rate of heat transfer through the thermosyphon is approximately proportional to the rate of condensation, the means of controlling the level of condensate in the condenser reservoir comprising a downcomer tube and orifice can be arranged to maintain a constant heat transfer rate over a wide range of operating conditions of the thermosyphon such as variations in the heat source and heat sink temperatures.

The axial length of the condenser 5 can be divided and a plurality of axially spaced condenser reservoirs can be formed producing a smaller variation in the liquid levels in each condenser than with a single condenser reservoir and therefore further reducing the variation of flow rate with condensate level in the condenser reservoirs.

The flow in the downcomer 9 can effectively be stopped by any convenient means, for instance by generating small quantities of vapour in the downcomer 9 above the orifice 17. The vapour can be produced by an electrical heating element located in the downcomer tube above the orifice 17.

Several downcomer tubes 9 may be provided from the condenser 5 to the evaporator 4, each having an orifice and the flow from the condenser 5 to the evaporator 4 may be controlled by selectively generating small quantities of vapour above the orifices of respective downcomers.

FIG. 2 illustrates a thermosyphon in which the liquid condensate in the condenser 5 is controlled by the vapour temperature in the thermosyphon. The thermosyphon has a pair of downcomer tubes 9*a* and 9*b* from the bottom of a control condenser 18 to the evaporator 4, the downcomers 9*a*, 9*b* having an orifice 17*a* and 17*b* respectively. Thermostatic control valves 10*a* and 10*b* are located in the respective downcomers 9*a* and 9*b*, to control the flow of condensate in the respective downcomer. The valve 10*a* can be arranged to open when the vapour reaches a given temperature and the condensate level in the control condenser 18 will fall, exposing more of the effective control condenser surface to the vapour, tending to lower the vapour temperature. If the exposed condenser surface is still inadequate the vapour temperature will continue to rise until it reaches a given higher temperature at which the second valve 10*b* will be opened and the flow from the control condenser 18 to the evaporator 4 will be increased, and the condensate level in the control condenser 18 will further fall, again exposing more of the effective control condenser surface to the vapour. By suitable design of the thermosyphon and selection of the operating temperatures of the thermostatic valves 10*a*, 10*b* the vapour can effectively be maintained at an approximately constant temperature. Valves 10*a* and 10*b* may be solenoid operated so that the heat transfer of the thermosyphon may be altered as desired by an operator of the thermosyphon.

The thermosyphon illustrated in FIG. 2 has a primary condenser 5 located above the control condenser 18, having a separate drain tube 12 to drain condensate to the evaporator 4.

The downcomers 9 in the thermosyphon illustrated in FIG. 1, and 9*a*, 9*b* in FIG. 2, can be located outside of the thermosyphon tube 1 if desired, as also can the thermostatic valves 10*a* and 10*b* in FIG. 2, which could then conveniently be replaced by respective hand-operated valves. The downcomers 9*a* and 9*b* might in certain applications be replaced by a single downcomer, and the valves 10*a*, 10*b* which may be proportionally controlled, might be replaced by a single downcomer.

In the thermosyphon illustrated in FIG. 3, the level of the liquid in the condenser reservoir 16 is controlled by a vapour lift pump (or internal thermosyphon) located within the thermosyphon tube. At the bottom of the downcomer tube 9 a header tube 13 connects the downcomer to a number of riser tubes 14, two of which are shown in FIG. 3. The outlets of the riser tubes 14 are positioned at a level above the top of the condenser reservoir 16, so that after some time heat transfer will be virtually stopped when the condenser reservoir 16 is filled with condensate. The level of the liquid in the condenser reservoir 16 can be controlled by heating one or more of the risers 14 by an electrical coil 15, or some other means, producing a vapour lift pump which will pump a vapour/liquid mixture out of the riser outlet, the liquid therefrom falling under gravity back into the evaporator 4. The liquid condensate level in the reservoir 16, and hence the rate of heat transfer can be controlled by the degree of heating of the riser, or by the number of risers heated.

In certain applications it may be possible to use the heat source at the evaporator to heat the riser tubes to produce the vapour lift pump, particularly as in many applications of the thermosyphon there is a relationship between the source temperature and the required effective condenser surface. Alternatively some other heat source in the vicinity of the thermosyphon may be employed to heat the risers, and if necessary the riser tubes can be taken outside the thermosyphon tube.

FIG. 4 illustrates a thermosyphon having a supplementary condenser 19 located outside of the thermosyphon tube 1. The inlet 21 to the supplementary condenser 19 is at a point below the main condenser 5, and the condensate liquid is returned through the outlet 22 to the thermosyphon tube 1 and evaporator 4 via a thermostatic or mechanically controlled valve 20. The level of liquid condensate in the supplementary condenser 19 and hence the heat transfer may be controlled by the valve 20, and thus the thermosyphon vapour on the heat source temperature controlled.

In all the embodiments described the amount of liquid that can be retained in the condenser is small compared with the liquid in the evaporator, so that the difference in levels of the liquid condensate in the condenser reservoir has little or no effect on the evaporator surface, and hence rate of evaporation. However it may be possible, as described in my co-pending U.S. patent application Ser. No. 513,741, to combine control of the effective evaporator surface and control of the effective condenser surface to control the operation of the thermosyphon.

To ensure satisfactory wetting of the evaporator surface in the embodiments of the invention described and illustrated, a wick may be positioned around the evaporator surface of the thermosyphon vessel. Such a wick may allow the thermosyphon to operate satisfactorily with less working liquid and vapour.

It will be appreciated that in the application of the embodiments of the invention described, suitable liquids will be required having a suitable vapour pressure and the dimensions of the components of the thermosyphons will depend on the application of the thermosyphon. The thermosyphon tube can be of any convenient cross section, and the thermosyphon may be used with its primary axis other than vertical.

The invention, although primarily described in relation to thermosyphons in which gravitational forces act on the liquid, may also be applied where other forces act on the liquid, such as centrifugal forces.

I claim:

1. A two-phase thermosyphon comprising a closed vessel of tubular form containing a liquid in contact with its vapour and having: a lower end at which is located an evaporator where heat may be absorbed by vaporisation of liquid; an upper end at which is located a condenser where heat may be given up by condensation of vapour; a cylindrical baffle located at the upper end of the vessel, and sealed to the vessel wall through which vapour may rise from the evaporator; a condenser reservoir of annular cross-section located adjacent the condenser having an inner surface defined by the baffle and an outer surface which forms part of the condenser whereby heat may be transferred from a heat source adjacent the evaporator to a heat sink adjacent the condenser at a rate dependent on the level of liquid in the condenser reservoir; and a connecting tube for limiting the said rate of heat transfer, said tube interconnecting the lower end of the condenser reservoir and the evaporator and being provided with a constriction at its lower end to cause liquid to accumulate in the condenser reservoir when the rate of heat transfer, and hence the rate of condensate flow, exceeds a predetermined value, so that when the rate of heat transfer exceeds the said predetermined value the level of liquid in the condenser reservoir rises and the rate of heat transfer correspondingly falls.

* * * * *